United States Patent [19]

Lee

[11] Patent Number: 4,915,105

[45] Date of Patent: Apr. 10, 1990

[54] MINIATURE RESPIRATORY APPARATUS

[76] Inventor: Tien-Chu Lee, P.O. Box 10160, Taipei, Taiwan

[21] Appl. No.: 257,640

[22] Filed: Oct. 28, 1988

[51] Int. Cl.[4] ..... A62B 7/00; A62B 9/04; A62B 23/02; A62B 7/10

[52] U.S. Cl. ..... 128/205.27; 128/206.11; 128/206.18; 128/207.18

[58] Field of Search ..... 128/205.27, 205.29, 128/206.11, 206.12, 206.15, 206.18, 206.27, 207.13, 201.11, 205.12, 204.18, 205.22, 201.25, 207.18

[56] References Cited

U.S. PATENT DOCUMENTS

| | | | |
|---|---|---|---|
| 443,191 | 12/1890 | Illing | 128/205.29 |
| 718,785 | 1/1903 | McNary | 128/207.18 |
| 838,434 | 12/1906 | Morgan | 128/205.29 |
| 1,192,186 | 7/1916 | Greene | 128/207.13 |
| 1,221,246 | 4/1917 | Travers | 128/206.11 |
| 1,270,404 | 6/1918 | Garnett | 128/205.29 |
| 1,443,820 | 1/1923 | Hudson | 128/205.29 |
| 1,610,793 | 12/1926 | Kaufman | 128/206.18 |
| 2,100,374 | 11/1937 | Biever | 128/206.12 |
| 2,702,089 | 2/1955 | Engelder | 128/205.27 |
| 2,792,000 | 5/1957 | Richardson | 128/207.13 |
| 3,731,678 | 5/1973 | Pyzel | 128/205.27 |
| 3,902,486 | 9/1975 | Guichard | 128/206.11 |

FOREIGN PATENT DOCUMENTS

| | | | |
|---|---|---|---|
| 791798 | 12/1935 | France | 128/206.11 |
| 858736 | 12/1940 | France | 128/206.11 |
| 27118 | of 1896 | United Kingdom | 128/206.11 |
| 379381 | 9/1932 | United Kingdom | 128/206.15 |

*Primary Examiner*—Edgar S. Burr
*Assistant Examiner*—Kimberly L. Asher

[57] ABSTRACT

A respiratory apparatus including an air filter; a hose connected to the filter; a nose-connected breathing pipe connected with the hose and having two inhaling valves formed on two side openings of the pipe, two nostril connectors protruding rearwardly from the pipe to fluidically connect to a wearer's nostrils, and an exhalation valve formed in the front portion of the pipe; whereby upon an inhalation by the wearer, a clean air stream is inhaled into the wearer's nose through the inhalation valves, and upon an exhalation, exhaust air is discharged through the exhaling valve. The apparatus being comfortable to wear and providing improved dissipation of facial heat.

9 Claims, 2 Drawing Sheets

MINIATURE RESPIRATORY APPARATUS

BACKGROUND OF THE INVENTION

Joseph Raymond Hilton disclosed an improvement in and relating to breathing apparatus in his U. K. Patent Application GB 2,032,284 A comprising a housing which may be a half face mask, a full face mask or a helmet, sealed to the wearer to define a substantially closed chamber surrounding the wearer's nose and mouth, in which air is supplied to the helmet by a fan and air exits form the chamber through an exhale valve for a forced circulation of the breathing air of the wearer, and which, however, has the following drawbacks:

1. The mask built in a helmet is very heavy and is not suitable for a worker who works in an environment having minor dusts or pollutants laden in the air and having no danger of falling objects harmful for the worker.

2. Even a wearer's face may be fully shielded in the mask and helmet for preventing dust pollution, the shielding mask, except the exhale valve, may not well dissipate the heat accumulated within the mask, thereby causing uncomfortable feeling to the mask wearer.

3. The complete set of helmet, mask, fan, motor and dry cells seems to be complex and may increase production cost and maintenance problems.

4. Whenever a power failure is caused, the forced circulation effect will stop which will greatly influence a wearer's breathing difficulty.

5. The wearer's mouth is shielded by a mask which makes conversing with other people difficult.

The present inventor has found the drawbacks of a conventional breathing apparatus and invented the present miniature respiratory apparatus.

SUMMARY OF THE INVENTION

The object of the present invention is to provide a respiratory apparatus including an air filtering means, and a nose-connected miniature breathing means fluidically connected with the filtering means having two nostril connectors directly poking into a wearer's nostrils so that a wearer may inhale clean air through the filtering means and two inhaling valves in the breathing means, and wherein the exhaust air is exhaled through an exhaling valve formed in the breathing means, thereby eliminating a conventional face mask sealing on a wearer's face.

DETAILED DESCRIPTION

Figure 1:
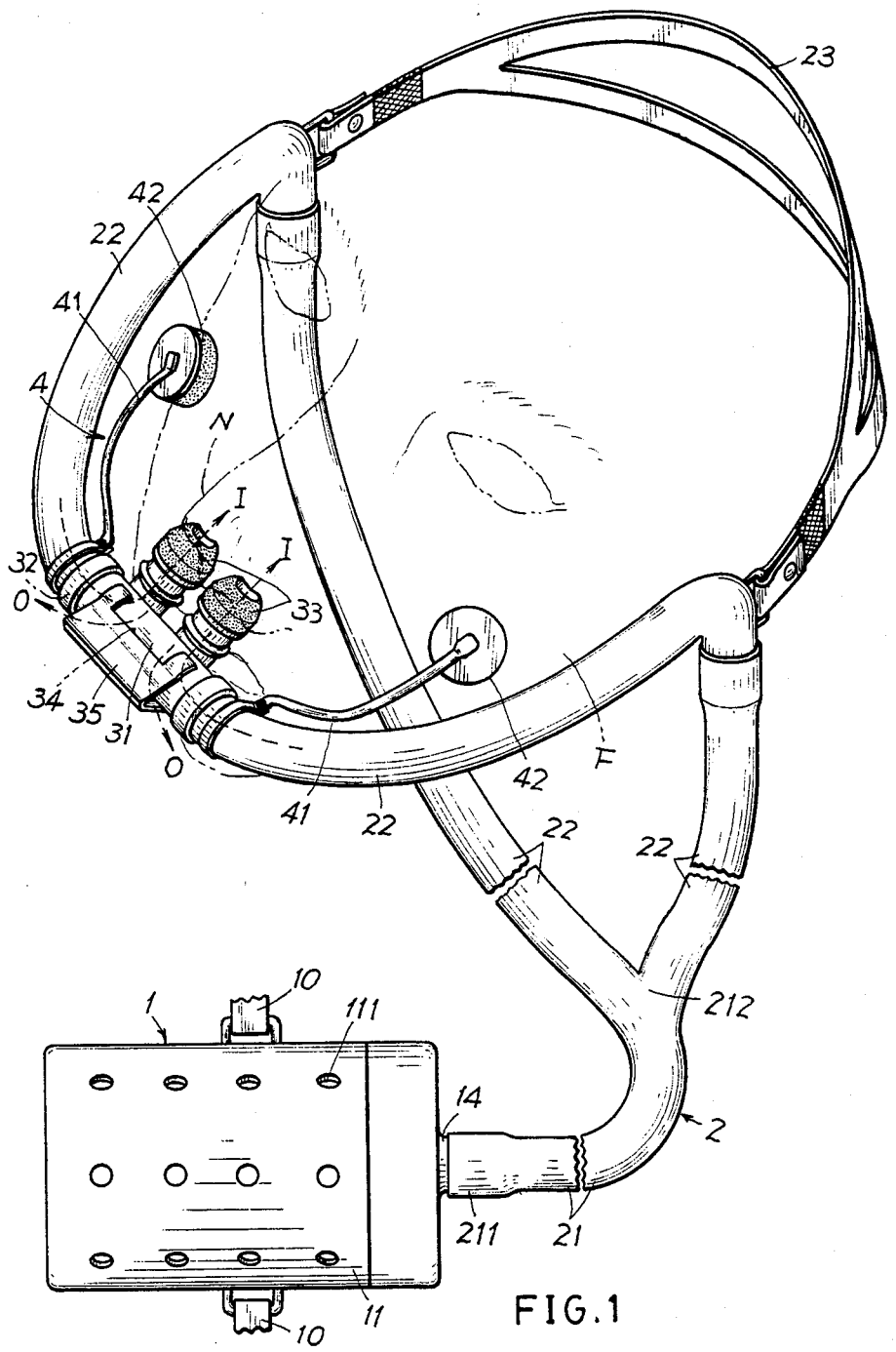
FIG. 1 is a perspective illustration of the present invention.

As shown in the figures, the present invention comprises: an air filtering means 1, an air delivery hose 2, a nose-connected breathing means 3, and a face supporting means 4.

The air filtering means 1 includes: an outer cylinder 11 having a plurality of perforations 111 drilled in the cylinder 11 and having a fastening belt 10 secured to a wearer's chest or waist, and inner cylinder 13 having a plurality of perforations 131 drilled therein and disposed within the outer cylinder 11, a filtering medium 12 such as selected from activated carbon, cotton, fibers or any other air-filtering materials defined between the outer cylinder 11 and the inner cylinder 13, and a filter outlet 14 protruding outwardly from the inner cylinder 13 fluidically communicated with the inner cylinder 13.

The air delivery hose 2 includes a main hose 21 having an outer end 211 connected with the filter outlet 14, and two bifuracte hoses 22 diverging from a bifurcate port 212 of the main hose 21, each bifurcate hose 22 having a discharge end 221 connected with the breathing means 3. A fastener belt 23 which may be formed as an adjustable belt may be further provided on the two hoses 22 for securing the hoses 22 and the breathing means 3 on a wearer's head.

The nose-connected breathing means 3 includes: a horizontal pipe 31 having two side openings 311 formed on two opposite ends of the pipe 31 each connected with a hose end 221, two inhaling valves 32 respectively formed in two side openings 311 of the pipe 31, two nostril connectors 33 protruding rearwardly from the pipe 31 and operatively poking into a wearer's nostrils N, an exhaling valve 34 formed on a front portion of the pipe 31, and a wind shield 35 mounted on the pipe 31 in front of the exhaling valve 34.

The horizontal pipe 31 has its two side openings 311 respectively connected with two discharge ends 221 of the two bifurcate hoses 22, each hose 22 being coaxially aligned with a longitudinal axis 310 of the pipe 31. The pipe 31 is formed with two rear openings 312 formed in a rear portion of the pipe 31 each opening 312 connected with each nostril connector 33, and also formed with two front openings 313 in a front portion thereof which openings 313 are operatively sealed by a flap 341 of the exhaling valve 34 when exhaling an exhaust air.

Figure 3:
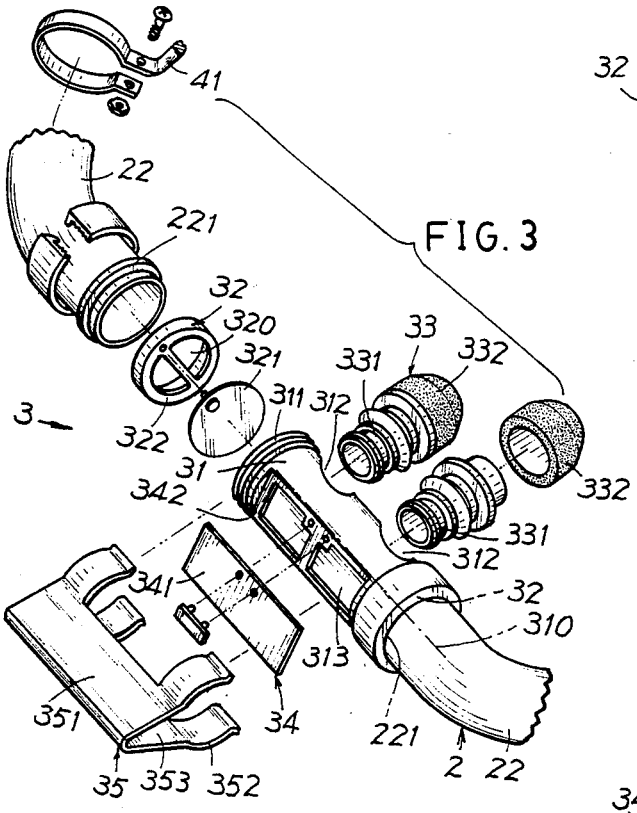
FIG. 3 is an exploded view showing the nose-connected breathing means of the present invention.
Figure 4:
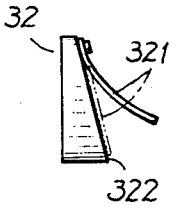
FIG. 4 shows an inhaling valve of the present invention.

Each inhaling valve 32, formed in a side opening 311 of the horizontal pipe 31 as shown in FIGS. 3 and 4, includes a flap 321 pivotally secured to a valve seat 322 and operatively sealing a valve opening 320 defined within the valve seat 322.

Figure 5:
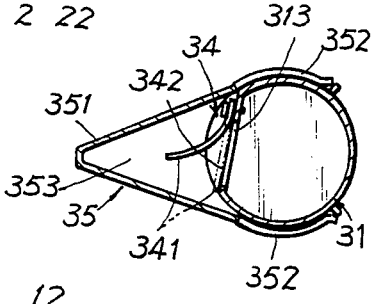
FIG. 5 is a side-view sectional drawing of the exhaling valve of the present invention.
Figure 2:
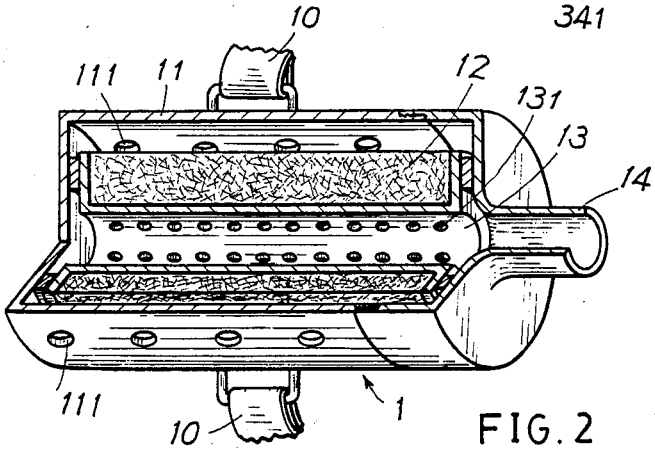
FIG. 2 is a cut-away illustration showing the air filtering means of the present invention.

As shown in FIGS. 3 and 5, the exhaling valve 34 includes a flap 341 pivotally secured to the pipe 31, and a valve seat 342 formed along an outer contour of the front openings 313, in which the flap 341 operatively seals the valve seat 342 and front openings 313 when inhaling a clean air.

The wind shield 35 as shown in FIGS. 3 and 5 includes: a wedge portion 351 tapered frontwardly having a cross section formed as V-shape and two side openings 353 formed on two side ends of the wedge portion 351, and two clamps 352 protruding rearwardly from the wedge portion 351 clampingly mounted on the horizontal pipe 31 to place the wedge portion 351 in front of the exhaling valve 34. Each side opening 353 is defined between the wedge portion 351 and partial circumferential surface of the pipe 31. The tapered wedge portion 351 may shield the wind without forcing upon the flap 341 when a wearer drives a motorcycle and also reduce a wind resistance since it is tapered frontwardly.

The nostril connector 33 includes a telescopic tube 331 connected to each rear opening 312 and an elastomer packing 332 jacketed on a rear end of the tube 331 sealable with a wearer's nostril.

As shown in FIG. 1, a face supporting means 4 may be further provided in this invention, which comprises two brackets each bracket firmly held between a hose 22 and the wearer's face. Each bracket of face supporting means 4 includes an elastic rod 41 secured to the hose 22 near the pipe 31 and an elastomer pad 42 terminated on an oute end of the rod 41 resiliently riding on a wearer's face F. The supporting means 4 may serve as a buffer to reduce a load acting on a wearer's nose N for comfortable wearing of the present invention.

When using the present invention, an environmental air is filtered through filtering means 1, the hoses, the inhaling valves 32, the pipe and the nostril connectors 33 into a wearer's nostrils. Whereas a wearer's exhaust air is discharged through the nostril connectors 33, the pipe 31, the exhaling valve 34, and the side openings 353. The inhaling valve 32 is a check valve merely for entering air, whereas the exhaling valve 34 serving as a check valve for discharging air.

The present invention has the following advantages superior to the conventional U. K. patent application GB 2,032,284 A:

1. The breathing means 3 is quite small by eliminating a conventional face shield or mask, is more confortable, and better dissipates facial heat.

2. The breathing means 3 is usable by a wearer without requiring any additional driving energy, such as a dry cell, and without worrying about a power failure therefore.

3. The construction is so simple so that its production cost can be very low and its maintenance troubles can thus be reduced.

4. The wearer's mouth is not shielded and can have better conversation with other people.

The supporting brackets 4 may also be omitted for a small-weight respiratory apparatus of the present invention. The belt 10 with filter 1 can also be modified as a necklace-like loop or pendant hanging on a wearer's neck.

I claim:

1. A respiratory apparatus comprising:

an air filtering means having a filtering medium formed therein secured to a wearer's chest, waist or neck;

an air delivery hose having a main hose connected to an outlet of said filtering means and two bifurcate hoses branched from the main hose; and a nose-connected breathing means including a horizontal pipe having two side openings of the pipe connected to said two bifurcate hoses, two inhaling valves one in each said side opening of said pipe, two nostril connectors formed on a rear portion of said pipe poking into a wearer's nostrils fluidically communicated with a wearer's nostrils, said pipe, said hose and said filtering means, an exhaling valve formed in a front portion of said pipe opposite to said nostril connectors, and a wind shield mounted on said horizontal pipe in front of said exhaling valve, the improvement which comprises:

said wind shield including a wedge portion tapered frontwardly having a cross section of V-shape, two clamps protruding rearwardly from said wedge portion clampingly mounted on said horizontal pipe in front of said exhaling valve, and two said openings for discharging exhaust air, each side opening being defined between said wedge portion and the partial circumferential surface of said horizontal pipe, whereby upon an inhaling by a wearer, a clean air stream, after being filtered through said filtering means, is inhaled into a wearer's nostrils through said hoses, said inhaling valves, said pipe and said nostril connectors; whereas upon an exhaling by a wearer, the exhaust air is discharged outwardly through said nostril connectors, said pipe and said exhaling valve.

2. A respiratory apparatus according to claim 1, wherein said air filtering means includes an outer cylinder having a plurality of perforations drilled therein, an inner cylinder formed within said outer cylinder and having a plurality of perforations drilledin said inner cylinder, a filtering medium disposed between said outer cylinder and said inner cylinder, and a filter outlet protruding outwardly from said inner cylinder to fluidically connect said air delivery hose.

3. A respiratory apparatus according to claim 1, wherein said hose further includes a fastener strip secured to a wearer's head.

4. A respiratory apparatus according to claim 1, wherein each said inhaling vlave is formed in each said side opening of said horizontal pipe and includes a flap pivotally sealable on a valve seat defining a valve opening in said inhaling valve, said inhaling valve allowing an one-way flow of an air stream through said horizontal pipe upon inhalation by a wearer.

5. A respiratory apparatur according to claim 1, wherein each said nostril connector includes a telescopic tube connected to a rear portion of said horizontal pipe, and an elastomer packing macketed on a rear en dof said tube sealable in a wearer's nostril.

6. A respiratory apparatus according to claim 1, wherein said exhaling valve includes a flap pivotally secured to a front portion of said horizontal pipe, and a vlave seat formed on an outer contour of two front openings formed in a front portion of said pipe opposite to said two nostril connectors, said flap of said exhaling valve operatively sealing on said exhaling valve seat during a wearer's inhaling, but opening during a wearer's exhaling.

7. A respiratory apparatus according to claim 1, wherein said respiratory apparatus further includes a face supporting means having two brackets, each said bracket having one end secured to one of said bifurcated hoses near said pipe of said breathing means and having the other end thereof resiliently riding on a wearer's face.

8. A respiratory apparatus according to claim 7, wherein said brackets of said face supporting means include an elastic rod secured to said hsoe near said pipe and an elastomer pad terminated on said rod resiliently riding on a wearer's face.

9. A respiratory apparatus according to claim 1, wherein said air filtering means is secured to a wearer's chest, waist or neck by a fastener belt.

* * * * *